United States Patent [19]

Lint

[11] Patent Number: 4,602,122

[45] Date of Patent: Jul. 22, 1986

[54] AUTOMATICALLY-INSERTABLE CASE SUITABLE FOR WIRE-WOUND MAGNETIC CORES

[75] Inventor: James D. Lint, San Diego, Calif.

[73] Assignee: Varian Associates, Inc., Palo Alto, Calif.

[21] Appl. No.: 683,112

[22] Filed: Dec. 18, 1984

[51] Int. Cl.[4] ..... H01F 27/06

[52] U.S. Cl. ..... 174/52 R; 174/138 G; 336/65; 336/192

[58] Field of Search ..... 174/52 R, 52 PE, 138 G; 336/98, 65, 192, 229, 92

[56] References Cited

U.S. PATENT DOCUMENTS 3,184,536 5/1965 Vincent ..... 174/138 G
3,324,226 6/1967 Tems et al. ..... 174/52 R

FOREIGN PATENT DOCUMENTS 1269222 5/1968 Fed. Rep. of Germany ... 174/138 G
2135454 1/1973 Fed. Rep. of Germany ... 174/138 G
2257888 5/1974 Fed. Rep. of Germany ... 174/138 G

*Primary Examiner*—Arthur T. Grimley
*Assistant Examiner*—D. A. Tone
*Attorney, Agent, or Firm*—Stanley Z. Cole

[57] ABSTRACT

A case for holding a wire-wound magnetic core or other electrical component so that the leads can be automatically inserted on a circuit board which employs a base portion that is shaped and dimensioned for compatibility with conventional automatic insertion equipment. The base includes both plastically-deformable cantilever lead traps for mechanically gripping the leads to secure the component on the base as well as circular notches in the slots that define predetermined positions on the base at which to grip the leads to enable use of the case for automatic insertion.

1 Claim, 5 Drawing Figures

AUTOMATICALLY-INSERTABLE CASE SUITABLE FOR WIRE-WOUND MAGNETIC CORES

BACKGROUND OF THE INVENTION

This invention relates in general to electrical component packaging and the like, and particularly pertains to an automatically-insertable case that is suitable for toroidal inductors.

Circuit board fabrication is often accomplished with the aid of automatic insertion equipment. This equipment automatically handles electrical components and inserts the component leads into holes in the circuitboard. In order that electrical components, such as a wire-wound magnetic core, can be inserted on a circuitboard with such equipment, the component is often placed on a supporting structure or "case", that enables automatic handling. A typical existing case design for electrical components includes an open box with holes in the bottom for the wire leads. Once the leads are threaded through the holes, an adhesive or potting compound is used to secure the component to the case. Later the leads are sheared to length.

Such cases have certain drawbacks. Since they require the addition of an adhesive or potting compound to join the case and component, there are severe design limitations placed on the case. First, the lead holes in the case must be dimensioned for the wire size of the leads on the component to insure accurate positioning of the leads and prevent leakage of potting compound. Secondly, the case must match component shape and size to minimize the amount of expensive potting compound required.

These problems result in a need for unique and expensive tooling. And, there are higher production costs because the associated assembly procedures require more labor, energy, space, and tighter process controls.

Therefore, it is desirable to have a new and improved case suitable for electrical components that alleviates these problems.

It is desirable to have a case on which an electrical component can be mounted without the use of an adhesive or potting compound.

It is desirable to have a case suitable for a variety of components having different dimensions and wire lead sizes.

And, it is desirable to have a case on which to mount electrical components that is easily and inexpensively produced.

SUMMARY OF THE INVENTION

This invention recognizes the problems of the prior art and provides a new and improved automatically-insertable case with the desired attributes.

An exemplary embodiment of a case constructed in accordance with the invention includes a base on which to secure an electrical component having a number of wire leads, such as a wire wound magnetic core.

The base may be shaped and dimensioned for compatibility with conventional automatic insertion equipment, and it includes means, such as cantilever lead traps, for mechanically gripping the leads to secure the component on the base.

The base also includes means for defining predetermined positions at which to grip the leads. This enables use of the case for automatic insertion on a circuitboard.

The case is easier and less costly to manufacturer and use with various components. It handles a range of wire lead diameters while facilitating assembly and eliminating the need for expensive potting compounds to secure the component in place.

The above and other objects and many attendant advantages of the invention will become more fully apparent upon a reading of the detailed description in conjunction with the drawings wherein like numerals refer to like components throughout.

DETAILED DESCRIPTION

Figure 1:
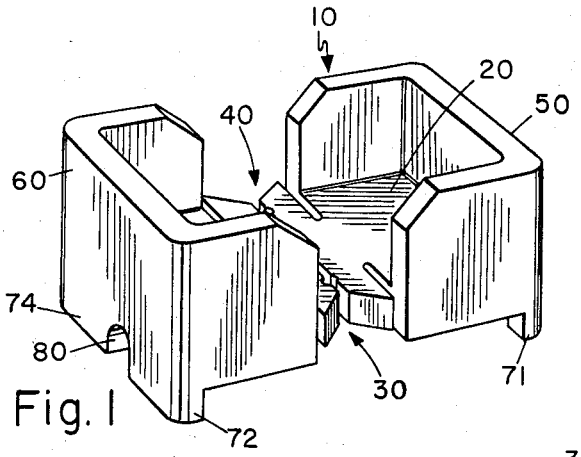
FIG. 1 of the drawings is a perspective view of an exemplary embodiment of an automatically-insertable case constructed in accordance with the invention.

An exemplary embodiment of an automatically-insertable case suitable for wire-wound cores that is constructed in accordance with the invention is shown in FIG. 1 where it is referred to generally by reference numeral 10. It includes base 20 on which is attached two cantilever lead traps, trap 30 and 40, that are used to mechanically secure a component on the base without the use of an adhesive or potting compound.

Base 20 includes upwardly-extending sides 50 and 60 that form an open box-like structure in which a toroidally-wound core is placed with its leads secured within lead traps 30 and 40. This box-like structure serves to physically stabilize the core since it extends upwardly some distance from the base. The sides also protect the component from undesired contact, and they provide surfaces that a conventional robot or other automatic insertion equipment can grip.

Downwardly-extending standoffs 71–74 (standoff 73 is not visible in FIG. 1) add rigidity to the base, as well as holding the base slighty above a circuitboard to allow cleaning after the component leads are soldered to the circuitboard.

Figure 3:
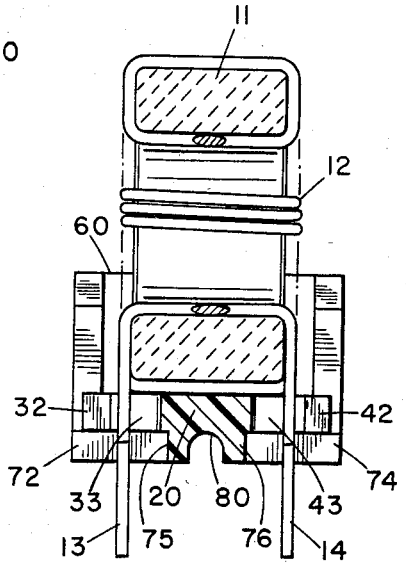
FIG. 3 is a sectional view taken on line 3—3 of FIG.2.
Figure 2:
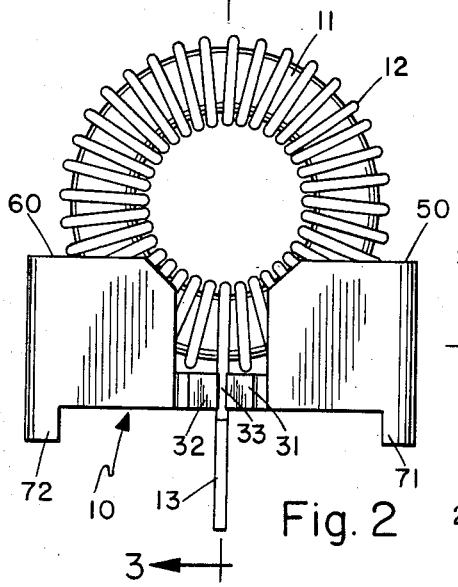
FIG. 2 is a side elevation view of the case with a wire-wound magnetic core in place.

An electrical component, such as the magnetic core 11 illustrated in FIG. 2, is secured upon base 20. The illustrated core includes winding 12 that terminates in leads 13 and 14 (FIGS. 2 and 3). These leads are forced into lead traps 30 and 40 where they are held squeezed in place to mechanically secure the magnetic core on the base.

Figure 4:
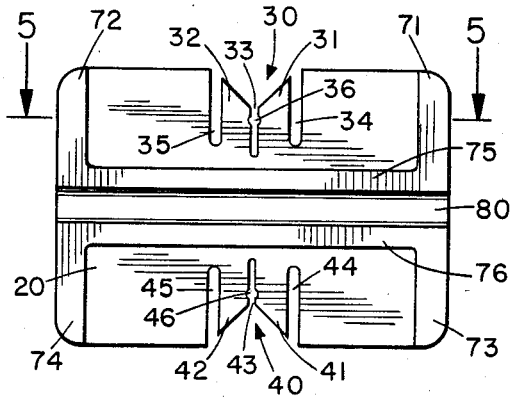
FIG. 4 is a bottom plan view of the case.
Figure 5:
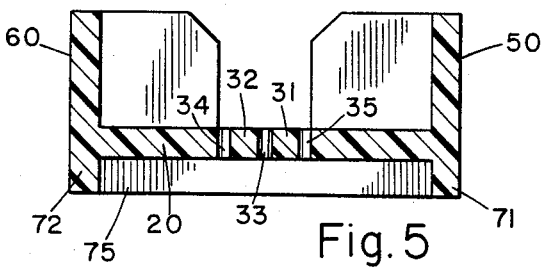
FIG. 5 is a sectional view taken on line 5—5 of FIG. 4.

Further details of the lead traps are shown in FIGS. 4 and 5. Lead trap 30, for example, includes outwardly-extending fingers 31 and 32 that define a slot 33. Slot 33 is slightly narrower than the diameter of leads 13 and 14 so that the leads can be forced into and squeezed within the slot to mechanically hold the leads in place. Relief slots 34 and 35 are formed in the base to define the fingers which can be visualized as cantilever beams extending from the base. These fingers constitute a cantilever lead trap that plastically deform when a wire is forced into slot 33, and in attempting to plastically recover to their original position they squeeze the lead so that the lead and the magnetic core are mechanically held in place on the base.

Slot 33 includes circular notch 36 for defining a predetermined position on the base at which to grip the lead. Another notch shape may be employed, such as a triangular notch, but even with the notch, this part of the slot is slightly narrower than the diameter of the corresponding component lead so that the lead is squeezed in place in a predetermined position. For some applications it may be adequate to omit the notch and position the leads simply by forcing the leads to the correct position within the slot, and it is within the inventive concepts herein disclosed to use the slot in this manner for defining a predetermined position on the base at which to grip the lead. In addition, the wire can be heated to soften the base material so that the wire forms its own notch in which it is trapped as the base cools.

With the lead in a predetermined position on the base, the base and component can be automatically inserted on a circuit board using conventional automatic insertion equipment. The insertion equipment is not shown in the drawings, but it grips the sides of the case in relation to which the lead is precisely positioned.

The illustrated embodiment includes two cantilever lead traps extending outwardly from base 20 in generally opposite directions. Lead trap 40 in FIG. 4 is similar to lead trap 30, reference numerals being increased by 10 over those designating similar features of lead trap 30. The two lead traps accomodate the two component leads and firmly secure the component on the base. Additional cantilever lead traps can be employed for components with more than two leads.

Between downwardly-extending standoffs 71–74 are formed ribs 75 and 76 which define channel 80 (FIGS. 4 and 5). These ribs serve to strengthen the base in the area where the slots are formed. The groove narrows the ribs to the thickness of the standoffs and base to facilitate injection molding according to know techniques.

The illustrated case is of unitary construction, injection molded from suitable material such as that sold under the trade name VYDYNE (909 NYLON RESIN) by Monsanto Corporation. The case is approximately 0.65 inch by 0.45 inch (outside dimensions) with the upwardly-extending sides extending about 0.3 inch above a circuitboard, and the interior is of suitable size for a one-half inch donutshaped toroidally wound core. The base is about 1.06 inch thick, and the fingers are defined by forming the base with three generally parallel slots. The center slots (slots 33 and 43) are approximately 0.01 inch wide and the two outer slots (relief slots 34, 35, 44, and 45) are approximately 0.025 inches wide.

Thus, this invention provides a new and improved case on which to secure an electrical component such as a toroidally-wound magnetic core. It is easily and inexpensively manufactured from readily available materials with a minimum of process control, and it enables a component to be secured in place by simply snapping the leads into the cantilever lead traps. It may be used with automatic insertion equipment, or for hand assembly.

As various changes may be made in the form, construction, and arrangement of the procedures and parts described herein, without departing from the spirit and scope of the invention and without sacrificing any of its advantages, it is to be understood that all matter herein is to be interpreted as illustrative and not in any limiting sense.

What is claimed is:

1. A case suitable for holding a wire-wound core, which comprises:

a base on which to secure a coil wound on a toroidal core having an associated pair of leads, said base being shaped and dimensioned for compatibility with conventional automatic insertion equipment, said base including means for inhibiting contact with the coil wound on a toroidal core secured on said base, said means for inhibiting contact including upwardly extending side portions forming an integral part of said base, and first and second pairs of finger formed as integral parts of said base, each said pair defining a slot slightly narrower than the diameter of corresponding one of the pair of leads of the coil wound on a toroidal core, said fingers being plastically deformable to enable the corresponding lead to be forced into said slot, each said slot having a notch at a predetermined position at which to grip a corresponding one of the pair of leads of the coil wound on a toroidal core, said first and second pairs of fingers extending outwardly in opposite directions.

* * * * *